US007172109B2

(12) United States Patent
Kuenstler et al.

(10) Patent No.: US 7,172,109 B2
(45) Date of Patent: Feb. 6, 2007

(54) SHIPPING BOX FOR OBJECTS

(75) Inventors: Annette Kuenstler, Köln (DE); Andrea Tzscheetzsch, Asbach (DE)

(73) Assignee: Deutsche Post AG, Bonn (DE)

( * ) Notice: Subject to any disclaimer, the term of this patent is extended or adjusted under 35 U.S.C. 154(b) by 75 days.

(21) Appl. No.: 10/903,042

(22) Filed: Jul. 30, 2004

(65) Prior Publication Data

US 2006/0022023 A1 Feb. 2, 2006

(51) Int. Cl.
*B65D 25/06* (2006.01)

(52) U.S. Cl. ..... 229/120.13; 229/120.17; 229/120.18

(58) Field of Classification Search ..... 229/120.13, 229/120.14, 120.15, 120.16, 120.18, 120.21, 229/120.17; 220/529, 530, 552
See application file for complete search history.

(56) References Cited

U.S. PATENT DOCUMENTS

| | | | | |
|---|---|---|---|---|
| 713,216 | A * | 11/1902 | Henning | 229/120.15 |
| 1,466,344 | A * | 8/1923 | Sardou | 229/120.13 |
| 2,794,585 | A * | 6/1957 | Wagner | 229/120.18 |
| 3,184,141 | A * | 5/1965 | Vrana | 229/120.13 |
| 3,326,444 | A * | 6/1967 | Farquhar et al. | 229/120.18 |
| 4,095,735 | A * | 6/1978 | Stone | 229/120.15 |
| 4,438,848 | A * | 3/1984 | Montealegre et al. | 229/120.21 |
| 4,969,595 | A * | 11/1990 | Teasdale | 229/117.17 |
| 5,335,845 | A * | 8/1994 | Liu | 229/120.18 |
| 5,657,925 | A * | 8/1997 | Norris | 229/120.13 |
| 5,909,840 | A * | 6/1999 | Schultheiss | 229/120.13 |
| 6,296,121 | B1 * | 10/2001 | Hershey | 229/120.21 |

FOREIGN PATENT DOCUMENTS

GB 2035961 A * 6/1980

* cited by examiner

*Primary Examiner*—Gary E. Elkins
(74) *Attorney, Agent, or Firm*—Marshall, Gerstein & Borun LLP

(57) ABSTRACT

The disclosure relates to a shipping box for objects that makes it possible, as desired, to separate objects to be mailed inside the shipping box without having to turn to additional external separation means. For this purpose, the shipping box includes four side walls arranged at right angles with respect to each other, a bottom element and a lid, whereby the bottom element and the four side walls form an interior space and a first upper flap of a side wall forms the lid. The lid can be folded with respect to the extended side wall, so that the folded lid closes the shipping box. The bottom element includes nested lower flaps of the four side walls that can be folded along folding edges. A second, a third as well as a fourth upper flap of the side walls can be folded along additional folding edges with respect to the appertaining side wall, whereby the upper flaps can be folded in in such a way that the interior space of the shipping box is either not divided or else it is divided into two or four compartments by partition walls formed by the upper flaps.

8 Claims, 4 Drawing Sheets

SHIPPING BOX FOR OBJECTS

FIELD OF THE DISCLOSURE

The disclosure relates to a shipping box for objects, including four side walls arranged at right angles with respect to each other, a bottom element and a lid, whereby the bottom element and the four side walls form an interior space and a first upper flap of a side wall forms the lid, whereby the lid can be folded with respect to the extended side wall, so that the folded-in lid closes the shipping box.

RELATED TECHNOLOGY

FR 2 780 707 describes a transport box whose side walls are lined with additional reinforcement elements. The additional reinforcement elements make it possible to place objects having a relatively high intrinsic weight inside the transport box so that they can be transported. In its unfolded state, the collapsible transport box constitutes a flat surface, whereby, when the side walls are folded up, they make contact with each other when the connecting elements are folded in. In order to close the transport box, flap pieces of two opposing side walls can be folded toward each other so that the flaps of the side walls lie on each other in the completely folded-shut state. In order to mechanically support the flaps of the opposing side walls that lie on each other, there are flaps on the two other opposing side walls and these flaps have smaller dimensions than the dimensions of the flaps that lie on each other, so that at least one flap having a larger dimension lies on the two flaps having a smaller dimension.

The above-mentioned transport box is flexible in terms of handling and also has a high mechanical stability for objects having a relatively high intrinsic weight. Although the above-mentioned transport box is configured in such a way that, in the unfolded state, it constitutes a flat surface and thus occupies only a small amount of space, the transport box provides only one single, predefined interior space. Objects to be transported—in spite of having a relatively high intrinsic weight—can also have quite small spatial dimensions so that, if the individual objects are supposed to be separated from each other, an additional separator must be inserted. This can be problematic if the additional separator, in turn, cannot be firmly fixed in place. In the worst case scenario, this leads to relative movement of the objects to be transported as well as of the additionally inserted separator inside the transport box, which can cause unwanted damage to the objects to be transported.

SUMMARY OF THE DISCLOSURE

The disclosure provides a shipping box that makes it possible, as desired, to separate objects to be mailed inside the shipping box without having to turn to additional external separators that are not an intrinsic part of the box. In order to increase the processing speeds during the shipping sequence, the shipping box should be structured in such a way that separation measures can be implemented very quickly.

According to the disclosure, this objective is achieved in a shipping box wherein a bottom element includes nested lower flaps of the four side walls that can be folded along folding edges, and wherein second and third upper flaps of the side walls can be folded along additional folding edges with respect to the appertaining side wall, whereby the upper flaps can be folded in such a way that the interior space of the shipping box is either not divided or else it is divided into two or four compartments by partition walls formed by the upper flaps.

DETAILED DESCRIPTION

Figure 1:
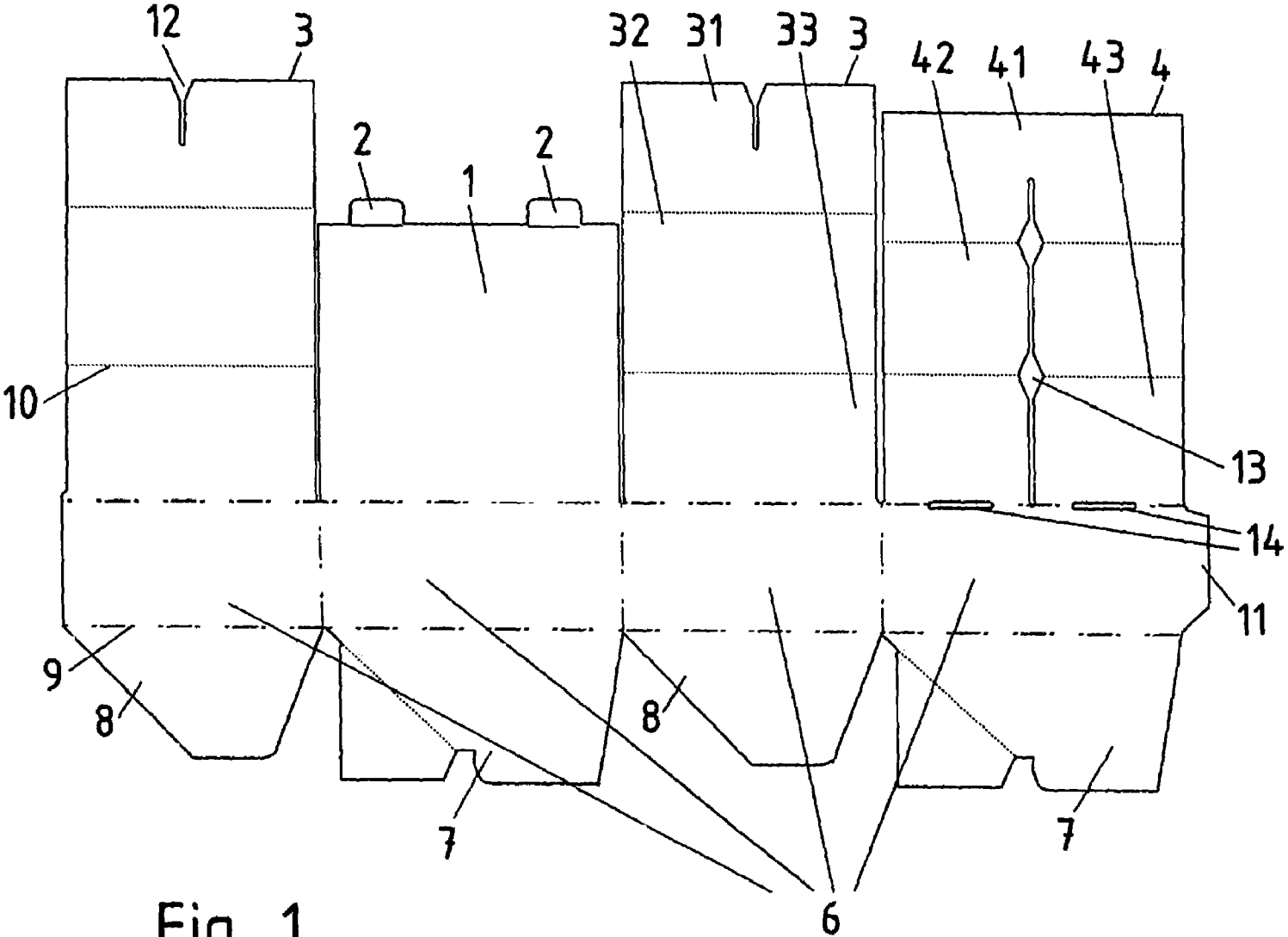
FIG. 1: a schematic depiction of a lateral surface of a completely unfolded shipping box of an especially preferred embodiment.

The paragraph beginning on page 2, line 19 have been changed as follows:

The shipping box according to the disclosure makes it possible, as needed, to leave the interior space—defined by the dimensions of the bottom element and of the side walls—undivided. Thus, as desired, the entire interior space is made available for the shipment of large objects. Moreover, the disclosed shipping box also makes it possible to create a division of the interior space into two equal-size compartments by means of a stable partition wall by folding in the upper flaps of the side walls. In this manner, for example, two objects that are each smaller than or equal in size to the spatial dimension of the compartment of the shipping box can be kept separate from each other, whereby the mechanically extremely stable separation effected by means of the partition wall is retained during the entire shipment route.

Moreover, the disclosed shipping box also makes it possible to divide the interior space into four equal-size compartments by means of two partition walls that run perpendicular to each other and that intersect each other, without the need for additional external means, for example, in order to mechanically support the partition walls. Hence, the disclosed shipping offers extremely flexible separation options for shipping objects having different spatial dimensions.

Moreover, the disclosed shipping box exhibits the flexibility of the state of the art in the unfolded state, namely, in the state in which the shipping box is not being used for shipping but rather is being kept in stock for future use. If necessary, the stored shipping boxes form a flat surface. The height of this flat surface of the completely unfolded shipping box equals the wall thickness of the side walls. This advantage of the disclosed shipping, namely, that it constitutes a flat surface in the unfolded state, results from the especially advantageous configuration of the bottom element, which is formed by nested lower flaps of the four side walls that can be folded along folding edges.

Through the use of folding edges on the shipping box, partition walls can be created that are exclusively in contact with the shipping box; that is to say, as a result of the upper and lower flaps of the side walls, the use of external partition elements is avoided altogether.

Furthermore, the disclosed shipping box allows a unique assembly by nesting the lower flaps of the four side walls, starting from their storage state, namely, as a flat surface. The assembled shipping box is made ready for shipping by the one-time gluing of the lower flaps as well as one side wall at a total ofjust three points. Once the gluing has been carried out at the three above-mentioned points, the shipping box allows the division of the interior space. The division can be varied at will and can be repeated.

The shipping box according to the invention thus makes it possible, as needed, to leave the interior space—defined by the dimensions of the bottom element and of the side walls—undivided. Thus, as desired, the entire interior space is made available for the shipment of large objects. Moreover, the shipping box according to the invention also makes it possible to create a division of the interior space into two equal-size compartments by means of a stable partition wall by folding in the upper flaps of the side walls. In this manner, for example, two objects that are each smaller than or equal in size to the spatial dimension of the compartment of the shipping box can be kept separate from each other, whereby the mechanically extremely stable separation effectuated by means of the partition wall is retained during the entire shipment route.

Moreover, the shipping box according to the invention also makes it possible to divide the interior space into four equal-size compartments by means of two partition walls that run perpendicular to each other and that intersect each other, without the need for additional external means, for example, in order to mechanically support the partition walls. Hence, the shipping box according to the invention offers extremely flexible separation options for shipping objects having different spatial dimensions.

Moreover, the shipping box according to the invention exhibits the flexibility of the state of the art in the unfolded state, namely, in the state in which the shipping box is not being used for shipping but rather is being kept in stock for future use. If necessary, the stored shipping boxes according to the invention form a flat surface. The height of this flat surface of the completely unfolded shipping box equals the wall thickness of the side walls. This essential advantage of the shipping box according to the invention, namely, that it constitutes a flat surface in the unfolded state, results from the especially advantageous configuration of the bottom element, which is formed by nested lower flaps of the four side walls that can be folded along folding edges.

Through the use according to the invention of folding edges on the shipping box, partition walls can be created that are exclusively in contact with the shipping box; that is to say, as a result of the upper and lower flaps of the side walls, the use of external partition elements is avoided altogether.

Furthermore, the shipping box according to the invention allows a unique assembly by nesting the lower flaps of the four side walls, starting from their storage state, namely, as a flat surface. The assembled shipping box is made ready for shipping by the one-time gluing of the lower flaps as well as one side wall at a total of just three points. Once the gluing has been carried out at the three above-mentioned points, the shipping box according to the invention allows the division of the interior space. The division can be varied at will and can be repeated.

Advantageous embodiments of the shipping box are the subject matter of Claims 2 to 8.

In an especially advantageous embodiment, the partition wall formed by the third upper flap is mechanically stabilized by means of a fourth upper flap of the side walls. This fourth upper flap can be folded along a folding edge with respect to the extended side wall. The mechanical stabilization is preferably achieved in that outer partial elements with an outer edge that runs parallel to the folding edge of the third and fourth upper flaps, which are folded into the interior space, each have the same spatial orientation and moreover, are in contact with each other. For example, if a surface-normal force acts on an adjacent outer partial element of one of the two upper flaps that lie partially on each other, then the other adjacent outer partial element generates a force that counteracts the surface-normal force.

In an especially preferred embodiment of the invention, each of the opposing lower flaps of the four side walls has an identical shape. As a result of the opposing arrangement of flaps having identical shapes, the nesting of the lower flaps for forming the bottom element is simplified. For this reason, the shapes of the lower flaps are extremely asymmetrical so that the mechanical stability of the bottom element is particularly high. As a result of the especially advantageous mirror-image arrangement due to the identical shapes of opposing lower flaps, the lower flaps can then engage with each other in a particularly stable manner.

At the same time, the use of identical shapes for opposing flaps allows a simplified production of the shipping box. As a result, manufacturing tolerances are minimized. For example, a flat lateral surface of the unfolded shipping box consists of identical copies of partial elements so that, during the production thereof, only a small number of stamping or processing tools are needed to shape the partial elements.

In another especially preferred embodiment, a first shape is configured as follows:

The first shape of the lower flap is formed by the folding edge, two slanted outer edges as well as by an outer edge that runs parallel to the folding edge. Here, it has proven to be especially advantageous that the slanted outer edges have different pitches from each other so that a second shape of the two remaining side walls is not hindered during the process of nesting. It has also proven to be advantageous to round off the slanted outer edge with the steeper pitch that makes the transition into the outer edge that runs parallel to the folding edge so that, after the nesting of the lower flaps of the four side walls, an area that has few edges is formed in at least part of the surface. This area with few edges of the bottom element thus created allows easier loading of the shipping box with objects since the number of edges in the vicinity of the bottom element is minimized.

The thus described first shape has similarities to the surface of a truncated, non-isosceles triangle.

In an especially preferred embodiment, the second shape of the lower flaps of the side walls is configured as follows:

The second shape of the lower flaps is formed by a folding edge, by a slanted outer edge, by an outer edge that runs predominantly perpendicular to the folding edge as well as by an outer element that extends predominantly parallel to the folding edge. The second shape of the lower flaps—in comparison to the first shape of the lower flaps—yields a larger portion of the surface area that forms the bottom element. Here, it should be kept in mind that the asymmetrical structure of the outer edges ensures a high mechanical stability of the shape that has the larger surface area. In order to ensure a lasting connection of the nested shapes and thus to ensure a bottom element that is durable, the two lower flaps of the first shape in the nested state rest partially on the two lower flaps of the second shape. The nested, differing shapes are glued together in the overlapping area. In order to simplify the nesting of the lower flaps of the side walls, the second shape has a perforated folding edge that runs from the end of the outer edge near the folding edge, said end running predominantly perpendicular to the folding edge at an angle to the middle area of the outer element that extends predominantly parallel to the folding edge. Since the area of the second shape delineated by the perforated folding edge can be folded along the perforated folding edge, the nesting is additionally facilitated.

In another especially advantageous embodiment, the outer element of the second shape that extends predominantly parallel to the folding edge is formed as follows:

An outer edge that runs parallel to the folding edge is rounded off in the area of an element dividing the outer edge in half lengthwise so that the outer edge that originally ran parallel to the folding edge makes a transition to a slanted section in the direction of the folding edge. At the end of this slanted section, there is an outer edge piece that runs perpendicular to the folding edge, whereby the end of this outer edge piece makes a transition to an additional outer edge piece that runs parallel to the folding edge.

At the end of the additional outer edge piece, there is a rising slanted section whose end—at the height of the rounded-off outer edge that runs parallel to the folding edge—is followed by another outer edge that runs parallel to the folding edge.

The thus described outer element comprises an outer edge that runs parallel to the folding edge and that has a recess in the area of the middle of the lengthwise extension of the outer edge. This recess includes a rounded-off slanted section, of an outer edge piece running perpendicular to the folding edge, of an outer edge piece that runs parallel to the folding edge as well as of another slanted section.

By means of an outer element configured in this manner, it is advantageously possible, when the lower flaps of the side walls are nested, to accommodate in the recess a part of the outer edge of the opposing flap of the second shape extending parallel to the folding edge. Hence, a fully automated nesting of the lower flaps using a machine can be achieved in an especially advantageous manner.

In another preferred embodiment, the second upper flap of the side walls is divided into five partial elements. The division into five partial elements is especially advantageous since it allows an extremely flexible division of the interior space. Moreover, it has proven to be especially advantageous to provide—in the middle of the flap parallel to the lengthwise extension—an elongated recess that starts from the folding edge and extends at least to the middle of the outer partial element with the outer edge that runs parallel to the folding edge. This elongated recess has dimensions that ensure that at least one partial element of an upper flap can be accommodated in the interior space when the upper flaps are folded in.

The elongated recess is advantageously situated in such a way that a total arrangement—consisting of at least one partial element of the third upper flap into which the elongated recess engages and of a partial element of the second additional upper flap—ensures a mechanical stability of the partition walls thus assembled.

In an especially preferred embodiment, the elongated recess is situated in such a way that a total arrangement—including partial elements of the third and fourth upper flaps into which the elongated recess engages and of a partial element of the second additional upper flap—ensures a mechanical stability of the partition walls thus assembled.

The second upper flap also has two perforated folding edges in order to form the four additional partial elements, whereby the two perforated folding edges preferably extend parallel to the folding edge. An intersection of each folding edge with the elongated recess is left open in a rhomboidal shape, whereby the rhomboidal recess facilitates the folding of the partial elements along each perforated folding edge.

In an especially advantageous embodiment, the third and fourth upper flaps are each divided into three partial elements by means of two perforated folding edges extending parallel to the folding edge. Here, it has proven to be especially advantageous for the outer partial element with the outer edge that runs parallel to the folding edge to have a recess in its middle in order to accommodate partial elements of upper flaps of the side walls, with an extension starting from the outer edge and extending at least to the middle of the partial element. Here, it has proven to be advantageous for the recess to be tapered from the outer edge in the direction of the middle of the outer partial element and, in doing so, to run at least partially in an orientation that is perpendicular to the folding edge. By means of the tapering from the outer edge in the direction of the middle of the outer partial element, at least the partial elements of the upper flaps are guided when the upper flaps of the side walls are folded in. This type of guidance prevents tipping of partial elements of upper flaps among each other.

Further advantages, special features and practical refinements of the disclosure can be found in the following description of preferred embodiments with reference to the drawings.

FIG. 1 schematically shows the lateral surface of an especially preferred embodiment of the completely unfolded shipping box. Four side walls 6 are followed by upper flaps 1, 3, and 4 as well as by lower flaps 7, 8. The upper as well as the lower flaps can be folded along a folding edge 9. To the side of one of the side walls 6, there is a gluing element 11 that is folded along the folding edge 9 onto the opposite side wall. The two lower flaps 8 of the first shape are each formed by the two slanted outer edges having different pitches as well as by the outer edge that runs parallel to the folding edge 9. Moreover, the two lower flaps 7 of the second shape are each formed by the slanted outer edge, by the outer element, by the outer edge that runs predominantly perpendicular to the folding edge as well as by a perforated folding edge 10.

A lid (upper flap 1) is formed with two tabs 2 as the upper flap of the side wall 6. The folding edge of the second upper flap 4 has two slit-shaped recesses 14 into which the tabs 2 of the lid 1 are folded. Such closure elements can be augmented or replaced by other closure elements familiar to the person skilled in the art.

The second upper flap 4 is divided by means of the elongated recess in conjunction with rhomboidal recesses 13 as well as with the perforated folding edges 10 into two partial elements 43 near the folding edge, a middle partial element 42 and an outer partial element 41.

The third and fourth upper flaps 3 are each divided by means of the two perforated folding edges 10 into a partial element 33 near the folding edge, a middle partial element 32 as well as an outer partial element 31. The outer partial element 31 has the tapering elongated recess 12.

Figure 2:
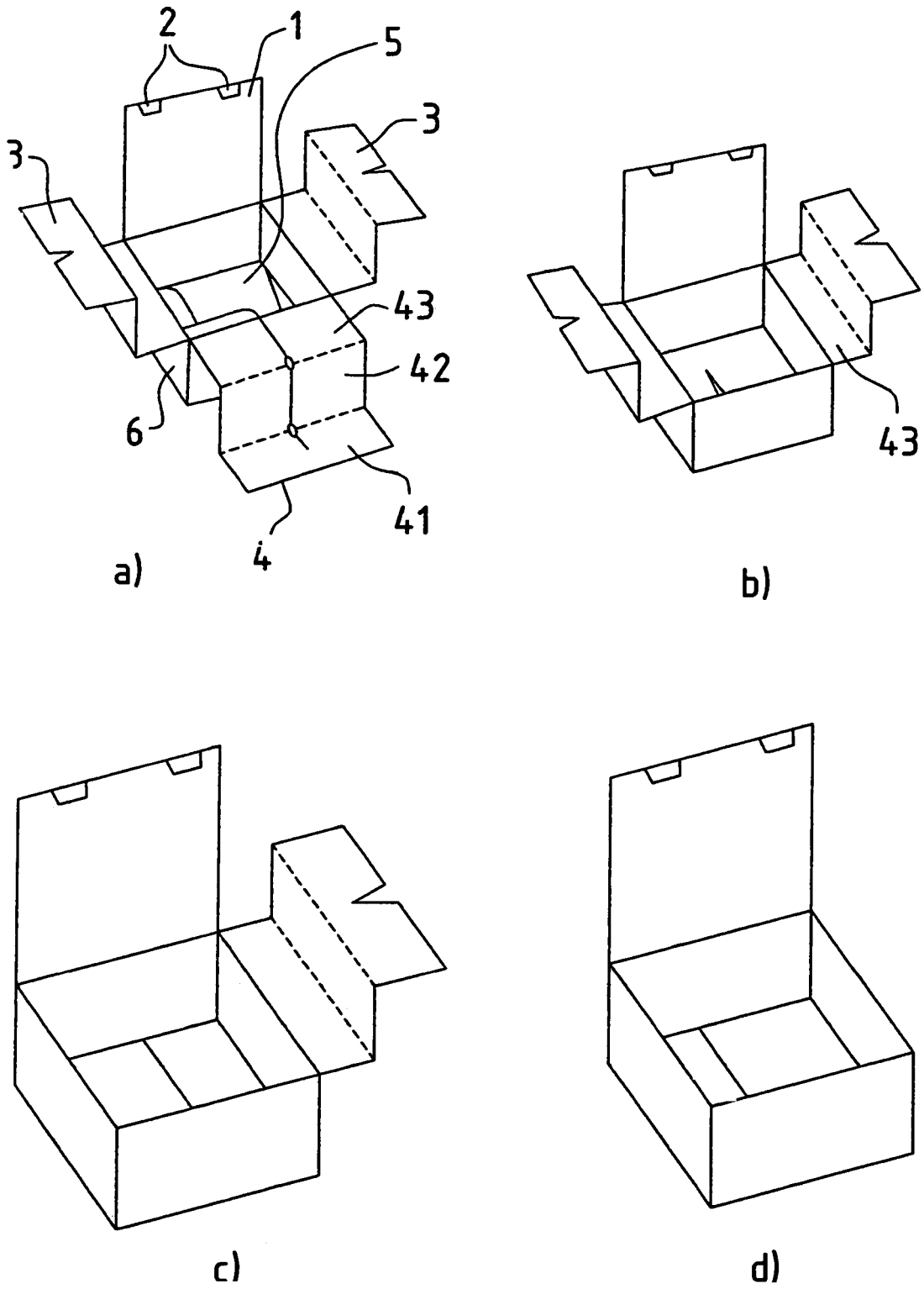
FIG. 2: a schematic depiction of the folding in of the upper flaps of the side walls, without dividing the interior space of the shipping box.

FIG. 2 shows a schematic depiction illustrating a sequence of folding procedures, in which order and in which way the upper flaps 3, 4 of the side walls 6 have to be folded into the interior space of the shipping box without dividing the interior space.

FIG. 2*a*) shows the shipping box in an initial configuration for the subsequent folding in of the upper flaps 3, 4 of the side walls 6. In the initial configuration of the shipping box, the bottom element 5 is already formed by the nested lower flaps of the four side walls 6. The lid 1 is in the folded up position.

FIG. 2*a*) also shows the elongated recess with the two rhomboidal recesses 13 as well as the two perforated folding edges 10 of the second upper flap 4. In the case shown, the elongated recess extends from the folding edge to the middle of the outer partial element 41 of the second upper flap 4.

Moreover, the third and fourth upper flaps 3 are each depicted by two perforated folding edges 10 that extend parallel to the folding edge 9.

Moreover, the tapering recess 12 on each outer partial element 31 of each of the two upper flaps 3 is depicted symbolically.

FIG. 2*b*) shows an intermediate step in the folding-in after the second upper flap 4 has been folded into the interior space. The second upper flap 4 is folded in in such a way that the two partial elements 43 near the folding edge lie in the folded-in state against the side wall 6 in the interior space of the shipping box. The remaining three elements 41, 42 of the second upper flap 4 thus extend parallel to the bottom element 5.

FIG. 2*c*) shows another intermediate step of the folding in after the third or fourth upper flap 3 has been folded into the interior space of the shipping box, whereby the partial element 33 of the folded-in upper flap 3 near the folding edge in the interior space of the shipping box lies against the side wall 6. The two remaining partial elements 31, 32 of the folded-in upper flap run parallel to the bottom element and lie on it.

According to the above-mentioned technique for achieving the intermediate result of the folding in (shown symbolically) in FIG. 2*c*), the still folded-out upper flap 3 is folded into the interior space. The interior space of the shipping box is thus not divided, FIG. 2*d*), and can be closed by folding shut the lid 1 as well as by inserting the tab 2 into the provided recesses 14 of the additional upper flap 4.

Figure 3:
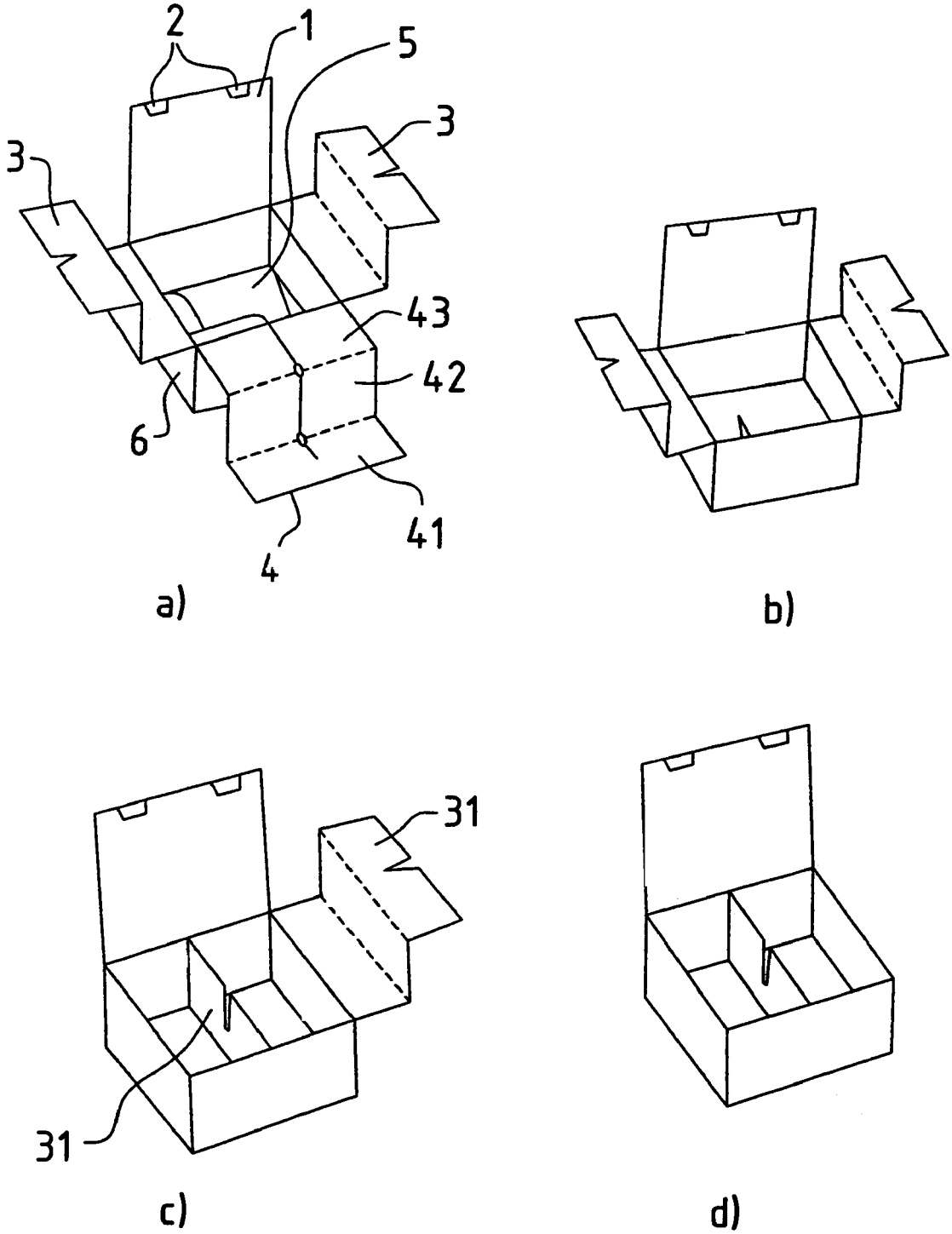
FIG. 3: a schematic depiction of the folding in of the upper flaps of the side walls in order to divide the interior space into two equal-size compartments.

By means of a schematic depiction, FIG. 3 shows a sequence of folding-in procedures of the upper flaps 3, 4 in order to divide the interior space of the shipping box into two equal-size halves by means of a partition wall formed by the flaps 3, 4. Starting with the initial situation, shown in FIG. 3*a*), first of all, the second upper flap 4 is folded info the interior space, whereby, in the folded-in state in the interior space of the shipping box, the two partial elements 43 near the folding edge lie against the side wall 6. The remaining three partial elements 41, 42 of the upper flap 4 run parallel to the bottom element 5.

The result of this intermediate step is shown in FIG. 3*b*). Subsequently, the third or the fourth upper flap 3 is folded into the interior space, whereby the outer partial element 33, which has the tapering recess 12, is set upright in the interior space. The outer perforated folding edge 10 serves for this purpose. The partial element 33 of the folded-in upper flap 3 near the folding edge once again lies against the side wall 6. This intermediate step result is shown in FIG. 3*c*).

In the same manner as the opposite upper flap 3 was folded into the interior space above, the still folded-out upper flap 3 is folded into the interior space so that, in the folded-in state, the outer partial elements 31 of the opposite upper flaps 3 lean against each other and run in a perpendicular orientation with respect to the bottom element 5, FIG. 3*d*).

Figure 4:
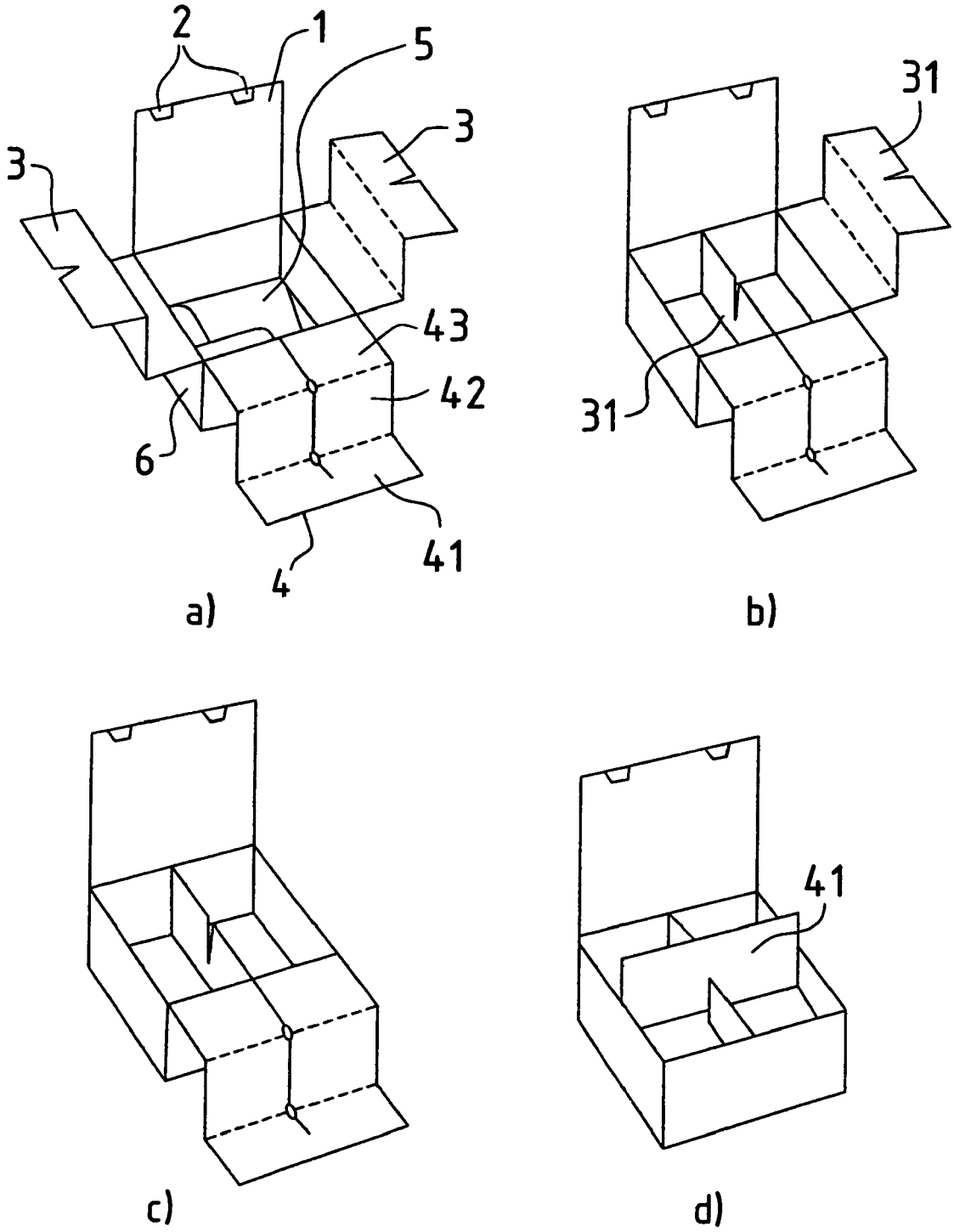
FIG. 4: a schematic depiction of the folding in of the upper flaps of the side walls in order to divide the interior space into four equal-size compartments.

FIG. 4 once again symbolically shows a sequence of folding procedures in order to fold in the upper flaps 3, 4 of the side walls 6 for dividing the interior into four equal-size spaces.

Here, FIG. 4*a*) once again shows the initial configuration of the shipping box in which the three upper flaps 3, 4 are folded outwards. In contrast to the folding-in sequence according to FIG. 3, first of all, starting from the initial configuration, the third or fourth upper flap 3 is folded into the interior space so that the outer partial element 31 of the flap 3 is set upright in the middle of the interior space. In order to achieve this upright orientation, like above, the partial element 33 of the flap 3 near the folding edge is folded into the interior space and oriented parallel to the extended side wall 6. The orientation of the middle partial element 32 of the flap 3 is parallel to the orientation of the bottom element 5, whereby finally the outer partial element is oriented perpendicular to the bottom element 5.

The intermediate result of the folding in of the upper flap 3 is depicted by FIG. 4*b*). Subsequently, the upper flap 3 that has not yet been folded in, like the already folded-in upper flap, is folded into the interior space so that, after the folding procedure has been carried out, the outer partial elements 31 of the flaps 3 are oriented parallel to each other in the middle of the interior space and perpendicular to the bottom element 5. The two tapering recesses 12 of the outer partial elements 31 of the folded-in upper flaps 3 thus lie at the same level inside the interior space and consequently offer an accommodation point for the outer partial element 41 of the second upper flap 4, whereby this outer partial element 41 of the additional flap 4 is inserted into the tapering recesses 12 in a perpendicular orientation to the bottom element 5. In order to carry out this insertion, first of all, the partial elements 43 of the upper flap 4 near the folding edge are folded into the interior space parallel to the side wall 6, so that the two middle partial elements 42 are oriented parallel to the bottom element 5, whereby the outer partial element 41 is inserted into the tapering recesses during the procedure of the parallel orientation to the bottom element 5. This insertion of the outer partial element 41 is depicted in FIG. 4*d*). After the complete insertion of the outer partial element 41, the outer partial elements 31, 41 of the upper flaps 3, 4, which are oriented perpendicular to the bottom element 5, form the partition walls for dividing the interior space into four equal-size parts.

LIST OF REFERENCE NUMERALS

1 lid
2 tabs
3 upper flaps
4 upper flap
5 bottom element
6 side elements
7 lower flaps
8 lower flaps
9 folding edges
10 perforated folding edges
11 gluing element
12 tapering recess
13 elongated recess with two rhomboidal recesses
14 slit-shaped recesses
31 outer partial element
32 middle partial element
33 partial element near the folding edge
41 outer partial element
42 middle partial elements
43 partial elements near the folding edge

The invention claimed is:

1. A shipping box for objects, comprising four side walls arranged at right angles with respect to each other, a bottom element and a lid, whereby the bottom element and the four side walls form an interior space and a first upper flap of one of the side walls forms the lid, whereby the lid can be folded with respect to one of the side walls, so that the folded-in lid closes the shipping box, wherein the bottom element comprises nested lower flaps of the four side walls and each nested lower flap can be folded along an appertaining folding edge, a second upper flap, a third upper flap, and a fourth upper flap of the side walls can be folded along an appertaining folding edge with respect to the appertaining side wall, whereby the upper flaps can be folded in such a way that the interior space of the shipping box is divided into two or four compartments by partition walls formed by the upper flaps and whereby the second upper flap is divided into five partial elements, whereby, in the middle of the second upper flap parallel to a lengthwise extension, there is an elongated recess having an expansion starting from the folding edge appertaining to the second upper flap and running at least to the middle of a partial element with an outer edge that runs parallel to the folding edge appertaining to the second upper flap.

2. The shipping box according to claim 1, wherein the fourth upper flap of the side walls can be folded along the appertaining folding edge with respect to the appertaining side wall, whereby the folded-in fourth upper flap at least partially ensures a mechanical stabilization of a partition wall formed by the third upper flap.

3. The shipping box according to claim 1, wherein opposing lower flaps of the four side walls have the same shape.

4. The shipping box according to claim 3, wherein a first shape of the lower flaps is formed by two slanted outer edges as well as by an outer edge that runs parallel to the folding edge appertaining to the respective lower flap, whereby the slanted outer edges have different pitches from each other and whereby the slanted outer edge with a steeper pitch is rounded off to make the transition into the outer edge that runs parallel to the folding edge appertaining to the respective lower flap.

5. The shipping box according to claim 3, wherein a second shape of the lower flaps is formed by a slanted outer edge, by an outer edge that runs predominantly perpendicular to the folding edge appertaining to the respective lower flap as well as by an outer element that extends predominantly parallel to the folding edge appertaining to the respective lower flap, whereby a perforated folding edge runs from an end of the outer edge near the folding edge appertaining to the respective lower flap, said end running predominantly perpendicular to the folding edge appertaining to the respective lower flap, at an angle to the middle area of the outer element that extends predominantly parallel to the folding edge appertaining to the respective lower flap.

6. The shipping box according to claim 5, wherein in order to form the outer element, an outer edge that runs parallel to the folding edge appertaining to the respective lower flap is rounded off as it makes a transition to a slanted section, whereby at the end of the slanted section, an outer edge piece runs perpendicular to the folding edge appertaining to the respective lower flap, whereby an end of the outer edge piece makes a transition to another outer edge piece parallel to the folding edge appertaining to the respective lower flap, whereby the end of an additional outer edge piece is followed by a slanted section at end of which—at the height of the rounded-off outer edge that runs parallel to the folding edge appertaining to the respective lower flap—there is another outer edge that runs parallel to the folding edge appertaining to the respective lower flap.

7. The shipping box according to claim 1, wherein two perforated folding edges that form four additional partial elements of the second upper flap extend parallel to the folding edge appertaining to the second upper flap through the second upper flap, the intersections of said partial elements with the elongated recess being left open in a rhomboidal shape.

8. The shipping box according to claim 1, wherein the third and fourth upper flaps are each divided into three partial elements by means of two perforated folding edges extending parallel to the folding edge appertaining to the respective third or fourth upper flap, whereby, in the middle of an outer partial element with an outer edge running parallel to the folding edge appertaining to the respective third or fourth lower flap, a recess whose expansion starts from the outer edge runs at least to the middle of the outer partial element, whereby moreover, the recess is tapered from the outer edge in the direction of the middle of the partial element and runs at least partially in an orientation that is perpendicular to the folding edge appertaining to the respective third or fourth lower flap.

* * * * *